United States Patent [19]

Knights

[11] 4,062,327

[45] Dec. 13, 1977

[54] INTERNAL COMBUSTION ENGINE

[76] Inventor: Peter Brian Knights, 8 Malwood Road West, Hythe, Southampton, England

[21] Appl. No.: 610,375

[22] Filed: Sept. 4, 1975

[30] Foreign Application Priority Data

Sept. 11, 1974 United Kingdom ..... 39661/74

[51] Int. Cl.[2] ..... F02D 19/00

[52] U.S. Cl. ..... 123/25 R; 123/32 SJ; 123/139 AJ

[58] Field of Search ..... 123/25 R, 25 C, 139 AJ, 123/139 AK, 32 SJ, 25 P, 25 A, 25 M, 25 N, 139 A, 139 AW, 139 DB

[56] References Cited

U.S. PATENT DOCUMENTS

| | | | |
|---|---|---|---|
| 1,376,277 | 4/1921 | Higgins, Jr. | 123/139 AJ |
| 1,467,137 | 9/1923 | Curran | 123/25 C X |
| 1,528,665 | 3/1925 | Fischer | 123/25 C X |
| 1,625,205 | 4/1927 | Grumme | 123/25 C |
| 2,551,073 | 5/1951 | Waldron | 123/25 C |
| 2,879,753 | 3/1959 | McKinley | 123/139 AJ |
| 2,986,134 | 5/1961 | Bernard | 123/139 AJ |
| 3,236,219 | 2/1966 | Bilisco | 123/139 AJ |
| 3,490,422 | 1/1970 | Bullis | 123/25 R |
| 3,665,902 | 5/1972 | Bloomfield | 123/32 SJ X |
| 3,742,926 | 7/1973 | Kemp | 123/139 DP |
| 3,911,871 | 10/1975 | Williams et al. | 123/25 N X |
| 3,926,169 | 12/1975 | Leshner et al. | 123/32 SJ |

*Primary Examiner*—Ronald H. Lazarus
*Assistant Examiner*—Ira S. Lazarus
*Attorney, Agent, or Firm*—Ostrolenk, Faber, Gerb & Soffen

[57] ABSTRACT

The present invention is concerned with apparatus for the introduction of fluids into the inlet gas stream of an internal combustion engine whereby variations in pressure in a combustion chamber control the fluid injected into the inlet gas stream. Pressure sensing means communicate with at least one combustion chamber of an internal combustion engine, and pump means responsive to said pressure variations sensed by said sense means to pump fluid from the fluid supply means to inject said fluid into said inlet gas stream of said engine.

10 Claims, 9 Drawing Figures

INTERNAL COMBUSTION ENGINE

The present invention relates to internal combustion engines and has particular reference to apparatus for the introduction of liquids into the inlet gas stream of such engines. It has long been established that the efficiency of an internal combustion engine is effected by the inlet air temperature and the humidity. Many proposals have been put forward for using fluids either mixed with fuel or by direct introduction into the inlet manifold, either above or below the butterfly in order to affect and improve the thermal efficiency of the internal combustion engine. In particular, water has been used with great advantage whereby the air charge taken in by the engine is cooled and the rate of flame propagation within the combustion chamber is reduced, thus, retarding the onset of detonation. The major advantage is the considerable saving in fuel of the order of up to 10% but the problems of using water are considerable. For instance, the volume ratio of water to fuel must not exceed a closely controlled percentage or efficiency will be lost rather than gained. Additionally, the water needs to be broken into droplets before introduction into the air inlet stream. For a given ratio of water to fuel, the particle size distribution of the water droplets appears to play an important part when it is desired to reduce the tendency to detonate or "pink" to a minimum.

It has been proposed to use pumps, either electrically driven or coupled for delivery to the throttle linkage or mechanical types similar to those used for fuel injection have been suggested.

These arrangements, while effective to a greater or lesser extent, are expensive compared with the savings in fuel to be achieved.

According to the present invention, however, there is provided apparatus for the introduction of fluids into the inlet gas stream of an internal combustion engine which apparatus comprises means for sensing pressure variations in at least one combustion chamber of an internal combustion engine, pump means responsive to said pressure variations sensed by the sensing means, fluid supply means for said pump, fluid outlet means from said pump and injection means connected with said fluid outlet means and adapted to inject fluid into said inlet gas stream of an internal combustion engine. The injection means may be a nozzle and disposed to inject fluid either upstream or downstream of a carburettor butterfly.

The pump may include valve means comprising a valve body having a plurality of holes for the passage of fluid from an upstream side to a downstream side and a resilient valve element fixedly secured to said body and juxtaposed said holes so that the edge of said element lifts to allow fluid to pass through said holes, the resilient valve element being flexed in the rest position to exert a bias so that on lifting to permit the passage of fluid, the resilient valve element moves against its bias.

The holes may be circumferentially spaced and the valve element may be annular and secured to the body radially outwardly of the holes. A stop may be provided to limit or restrict the lift of the edge of the valve element.

In order to ensure a restricted supply of fluid under idle conditions an antidribble valve may be provided.

The anti-dribble valve serves to control the flow rate of fluid to the gas stream when the engine is running at low power. Particularly where the fluid is a liquid it is preferred that the liquid be introduced as a fine spray. In this case, a problem at slow speed may arise in that the rate of supply of liquid is insufficient to form a fine spray and the result is that liquid dribbles from the nozzle into the manifold.

In some circumstances an accumulation of fluid is likely to build up whereby on opening the throttle suddenly, liquid fluid enters the cylinders to the exclusion of fuel with the result that the engine suffers a sudden retardation and is likely to stall.

The anti-dribble valve in accordance with one aspect of the present invention may comprise a valve chamber, a piston slidable in said chamber, inlet means debouching into said chamber, inlet closing means carried on said piston for movement therewith and adapted to close said inlet when the piston is juxtaposed thereto, biassing means to urge said piston to a position in which the inlet is closed, an outlet for said chamber on a side of the piston opposite said inlet and a bypass within said piston adapted to communicate with said outlet when the piston is urged against the biassing means by fluid under pressure, the arrangement being such that as the rate of fluid supply falls the biassing means urges the piston towards the closed position whereby the communication between the bypass and the outlet is obturated to curtail fluid supply from the inlet to the outlet.

Thus, in operation the piston is biassed toward the inlet valve until the by-pass is obturated from the valve chamber outlet. At this stage, no fluid passes to the nozzle until such time as the engine power has increased to such an extent as to increase the fluid pressure in the inlet valve, thereby urging the piston against its spring bias and permitting the by-pass to communicate with the chamber outlet thus allowing fluid to be supplied under increased pressure to the nozzle whereby the spray into the inlet manifold is maintained and dribbling of fluid in droplets is substantially prevented.

Under various work conditions for the engine it is desirable to control, within a limited extent, the rate of supply of fluid to the inlet manifold. This is best effected by means of a control valve comprising a longitudinal conduit, a longitudinal member disposed within said conduit so that the spacing between the conduit and said member forms a passage of small cross-section wherein the member and conduit are in longitudinal adjustment one with the other to permit variation of the length of said passage to vary the resistance to flow of fluid passing therethrough.

The engine may be a reciprocating engine of the conventional cylinder type or may be a rotary engine such as a Wankel engine.

The sensing means may include a spark plug having a conduit connecting the combustion chamber with a pressure chamber in said pump.

The pump may have a pressure chamber, a floating piston movable within said pressure chamber in response to pressure induced in said chamber. The pump may further include an inlet valve and an outlet valve whereby movement of the floating piston in response to pressure changes in the chamber results in movement of the piston and pumping of the fluid from inlet to outlet.

The fluid may be a liquid preferably water, but water with other additives or with proportions of fuels may be employed.

In particular, the present invention includes apparatus for the introduction of liquids into the inlet gas stream of an internal combustion engine which apparatus comprises a liquid container or source, a pump having a pump chamber, an inlet to said chamber connected with said liquid container or source, an inlet valve associated with said inlet, a pump outlet communicating with said chamber, an outlet valve associated with said pump outlet, a nozzle adapted to be inserted into or to inject into an inlet gas stream of an internal combustion engine and connected with said pump outlet, a floating pump piston disposed within said chamber, and conduit means communicating with a combustion chamber and said pump whereby variations in pressure causes movement of the floating piston which acts to pump liquid from said inlet to said outlet and to said nozzle.

The apparatus in accordance with the present invention has the advantage that the quantity of fluid metered into the inlet gas stream is directly dependent upon the conditions within one or more of the combustion chambers, that is to say, the higher the power being delivered the greater is the amount of fluid injected into the inlet gas stream in the manifold.

The invention also includes a spark plug of conventional design having a longitudinal groove axially disposed in the surface thereof extending below the roots of the threaded portion entering the cylinder for use in combination with an annular ring having a drilling therein whereby the plug and annular ring may be disposed within a cylinder head so that the longitudinal groove and the drilling communicate one with the other to provide a direct communication between the cylinder head and the pump chamber. In an alternative embodiment the thread portion of the plug may be provided with one or more grooves on the inner surface and/or one or more radial drillings juxtaposed the upper end of the threaded portion. Gaskets are preferably provided either side of the annular ring to prevent leakages.

The invention also includes a pump having a chamber, a conduit communicating with said chamber and adapted to be connected with the combustion chamber of an internal combustion engine, a floating piston disposed within said chamber, means biassing said piston to a datum position, a fluid inlet having an inlet valve and a fluid outlet having an outlet valve, said inlet and outlet valves being disposed on the side of the floating piston opposite to that of the conduit whereby variations of pressure within a cylinder head are sensed by the floating piston which moves against the biassing means in response to pressure changes within the cylinder head to move liquid from said inlet to said outlet.

The present invention also includes an internal combustion engine incorporating apparatus in accordance with the present invention.

Following is a description by way of example only and with reference to the accompanying informal drawings of apparatus in accordance with the present invention.

Figure 1:
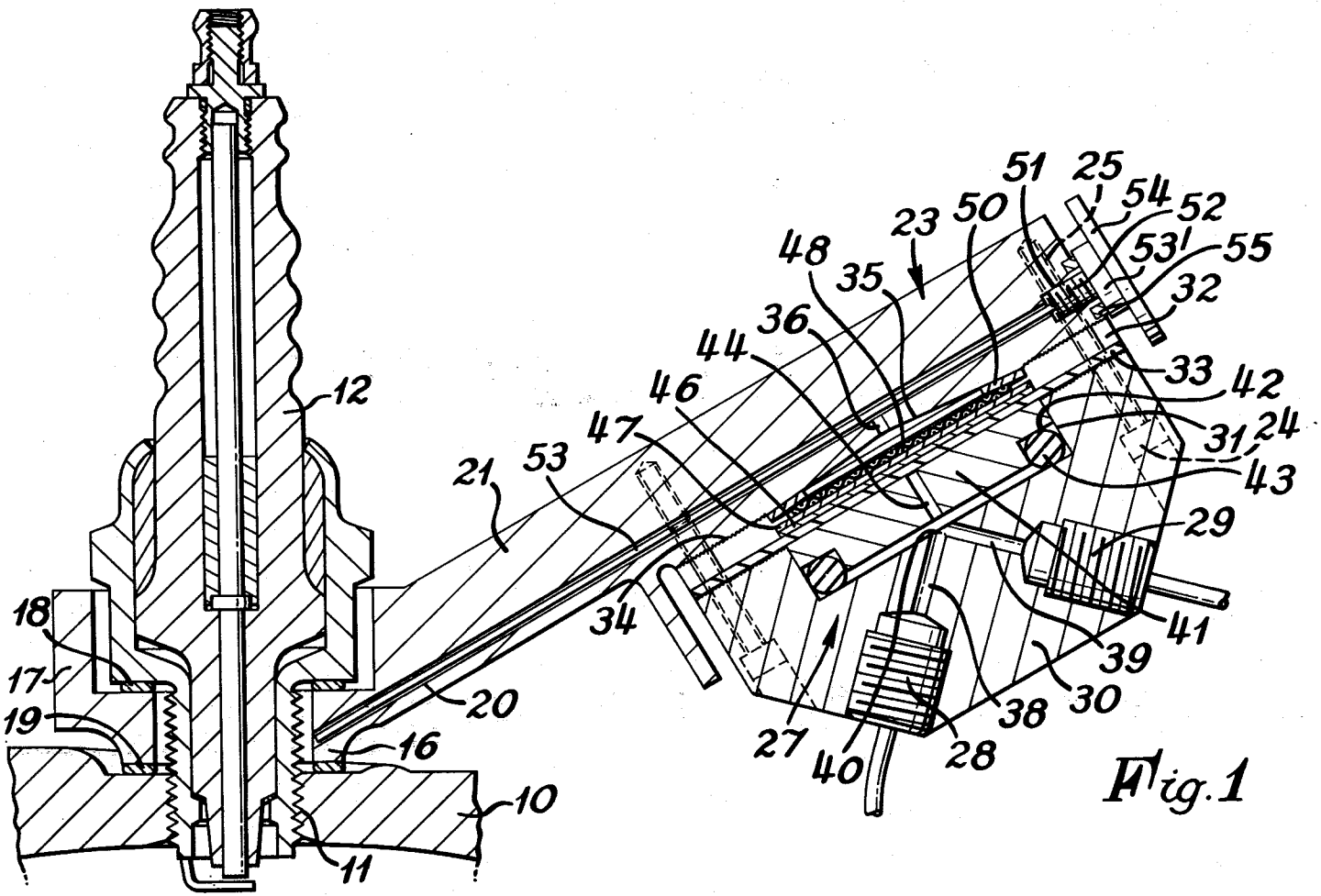
FIG. 1 is a section through the apparatus in accordance with the present invention.
Figure 2:
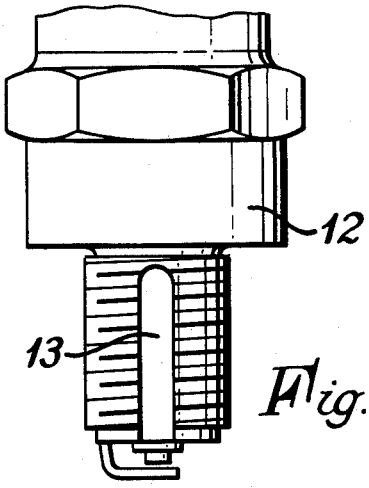
FIG. 2 is a fragmentary view of the spark plug of FIG. 1.
Figure 2A:
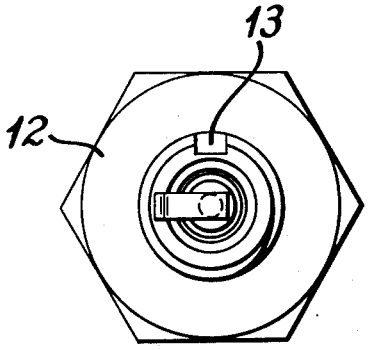
Figure 3:
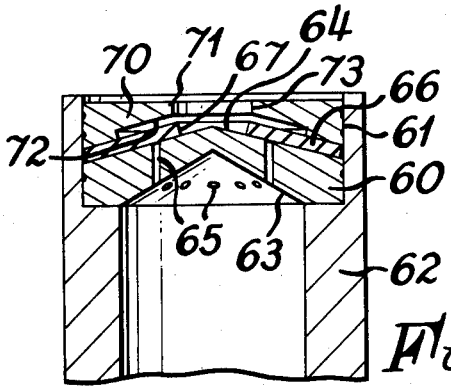
Figure 3A:
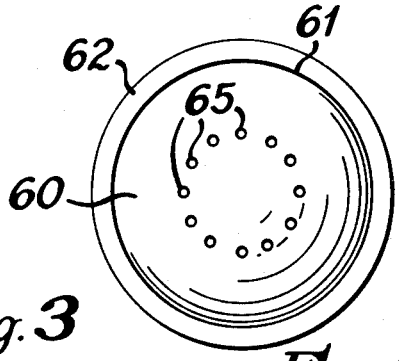
Figure 4:
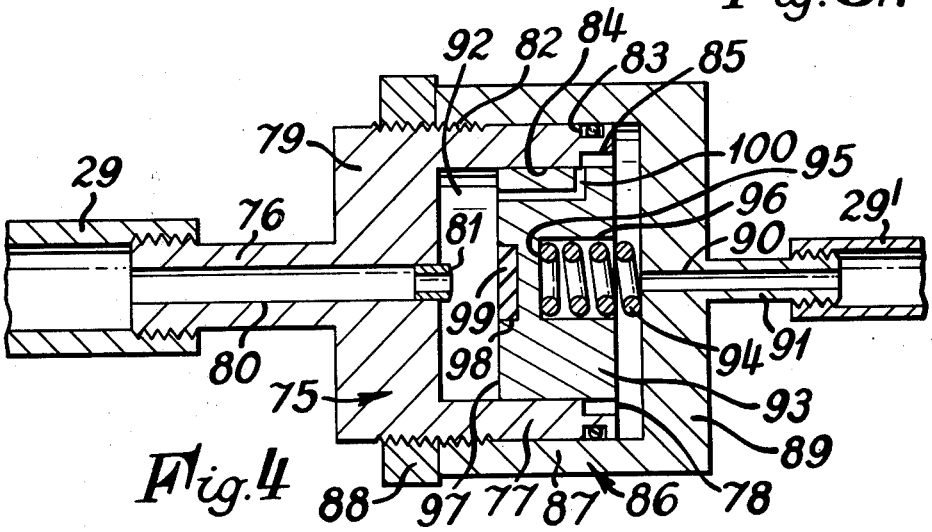
Figure 5:
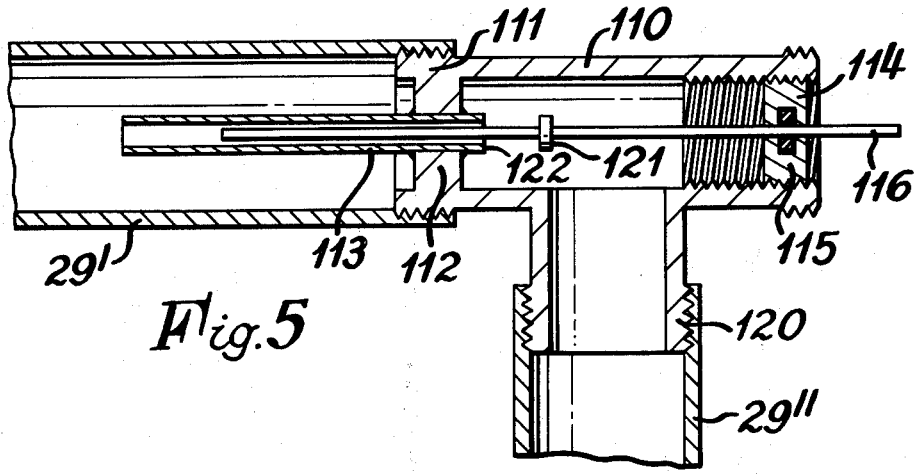

FIG. 2*a* is a bottom view of the spark plug of FIG. 2;

FIG. 3 is a section through an inlet and/or outlet valve for the pump of FIG. 1;

FIG. 3*a* is a cross-sectional plan view of the valve of FIG. 3;

FIG. 4 is a section through an anti-dribble valve for use in the apparatus of the present invention;

FIG. 5 is a section through a flow control device for use in the apparatus of the present invention.

Figure 6:
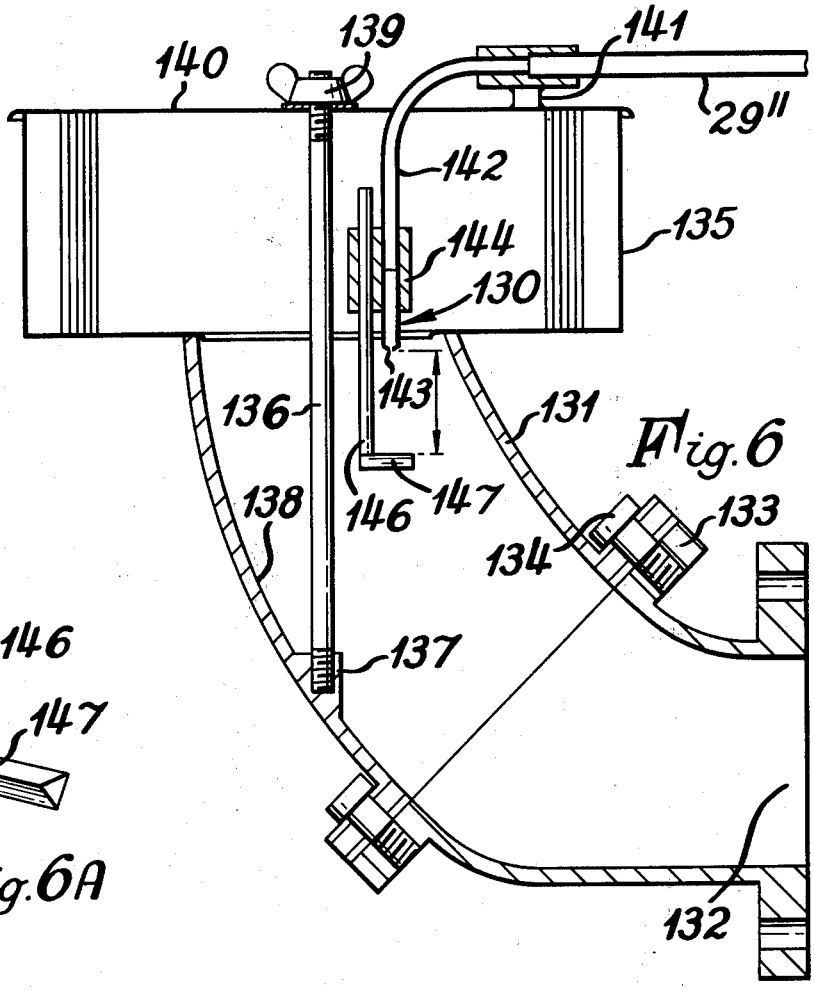
Figure 6A:
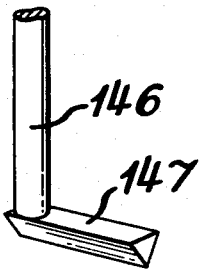

FIG. 6 is a section through an engine manifold showing one fluid injection means and FIG. 6A is a view in perspective of a fluid baffle.

The cylinder head 10 of an internal combustion engine of the reciprocating variety has a standard plug hole 11 adapted to receive a standard spark plug 12. The plug 12 has, in its threaded portion, a longitudinal groove 13 milled in the threads to below the thread roots to define a passage of approximately 10 or 15 thousandths inch, in depth between the wall of the plug hole and the inner surface of the groove 13 of the plug 12.

The plug 12 is entered into the plug hole 11 and serves to retain and trap an annular member 16 having an upstanding annular cup-shaped portion 17, gaskets 18 and 19 being disposed between the upper surface of the member 16 and the plug and the lower surface of the member 16 and the upper portion of the cylinder head 10. The member 16 has a longitudinal passage 20 extending lengthwise of upwardly inclined arm 21. The outer portion 23 of arm 21 remote from cup shaped portion 17 has secured thereto a pump indicated generally at 27, by means of bolts 24 threadably engaging blind bores 25 in outer portion 23 of arm 21.

The pump 27 comprises a substantially cylindrical body 30 having an upper body portion 32 separated from the main pump body 30 by means of a diaphragm 33 which is clamped therebetween. The outer portion 23 of arm 21 is provided with an annular seating surface 34 which is finished as a gramophone finish and is intended to mate with and locate upper casing portion 32. The area of the surface of arm 21 encompassed by seat 34 has a substantially frustoconical depression 35 the inner extremity of which communicates with a conduit 36 which communicates with passage 20. Cylindrical body 30 has a blind bore and which together with upper body portion 32 and adjacent arm portion 23 define a cylinder 31.

Pump body 30 accommodates an inlet valve 28 and an outlet valve 29 and associated inlet 38 and outlet 39 which communicate by means of common orifice 40, with the circular blind end of cylinder 31.

The cylinder 31 accommodates a piston 41 having an annular rebate 42 in the lower surface thereof accommodating an O-ring 43. The diaphragm 33 is formed of rubber, the under surface is juxtaposed the upper surface of piston 41. The cylinder portion defined by upper body portion 32 accommodates a first disc 46 formed of woven glass fibres impregnated with polytetrafluoroethylene and seated upon diaphragm 33 and a second identical disc 47 which abuts the upper surface of disc 46. A disc of metal mesh 48 is disposed above disc 47 and is retained in place by means of a retaining ring of glass impregnated polytetrafluorethylene 50.

The longitudinal passage 20 in arm 21 terminates at its extremity an expanded portion 51 which is screw threaded on its inner surface. The screw threaded expanded portion 51 accommodates a bush 52 carrying a rod 53 adapted to extend substantially the length of passage 20, the bush having on its outer surface a boss 53' and a small hand wheel 54; a sealing ring 55 being disposed between boss 53' and the extremity of arm 21 to effect a gas tight seal. By unscrewing the boss the rod 53 may be withdrawn and may be employed for cleaning passage 20 by inserting different size rods 53 in passage 20 the dimensions of passage 20 communicating with passage 36 may be controlled thus varying the high R.P.M. to pump delivery relationship to suit the engine installation concerned.

In operation, an increase in pressure in the cylinder of which head 10 forms a part, is transmitted via passage 13 and plug 12 to the annular recess in cup 17 and thence via passages 20 and 36 to the frustoconical space upward of the composite diaphragm assembly with the attendant discs and supports 46, 47 and 48.

The result of the increased pressure is to distend the diaphragm downwardly and to urge piston 41 to compress O-ring 43 and decrease the space between the lower surface of the piston and blind end of bore 31 to drive liquid from said space into outlet conduit 39 and out therefrom via outlet valve 29. Relaxation of the pressure in the cylinder results in the corresponding relaxation of the pressure above the diaphragm assembly and in consequence the piston 41 moves upwardly within its bore to increase the space between the lower surface of the piston and the end of blind bore 31 thereby admitting further liquid via inlet valve 28 and inlet 38 to the piston assembly. The extent of the transmission of pressure changes in the longitudinal passage 20 can be controlled by varying the size of the rod 53 disposed therein.

The inlet and outlet valves to pump 27 are shown in FIGS. 3 and 3A and each comprise a valve body 60 located in an expanded portion 61 of associated inlet sleeve 62, constituting the inlet 28 or the outlet 29 to the pump. The body 60 has a conical depression 63 in the downstream surface thereof and a convex conical surface 64 on the opposed upstream surface thereof.

The body 60 has a ring of circumferentially spaced holes 65 constituting a passage for fluid from the upstream side 63 to the downstream side 64 of body 60. A valve member 66 is constituted by an annulus of a resilient flexible material such as rubber cut from a flat sheet. The annulus is secured to the downstream surface 64 of body 60 such that the periphery of the annulus is juxtaposed the periphery of the body 60 and the inner circular edge 67 is disposed radially inwardly of the ring of holes 65, so as to overlay each of the holes 65 in body 60. The peripheral edge of member 66 is secured to body 60 by means of retaining ring 70. The retaining ring 70 is generally annular and has an inward projection 71, the surface 72 of which adjacent member 66 is spaced therefrom to limit the opening by flexing of member 66 away from holes 65 during passage of fluid therethrough.

In operation, fluid passes towards surface 63 of member 60 and the pressure of the fluid urges the member 66 away from the surface 64 to permit passage of fluid through holes 65, past member 66 and out of the annular opening 73 defined by the inner cylindrical edge of projection 71 of retaining ring 70.

This valve is inserted at the inlet and outlet of pump 27.

The outlet conduit 29 is coupled to an anti-dribble valve to prevent dribbling of fluid from the outlet nozzle when the engine is working at low capacity or low power output.

The dribble valve comprises a first body member 75, having an inlet conduit 76 connected to conduit 29 from the outlet of pump 27. The body 75 has a cylindrical portion 77 which is open at a forward end 78 and is closed at its rearward end 79 and is provided with a central inlet 80, terminating at the forward face of end 79 in an inlet nozzle 81. The outer cylindrical surface of the cylindrical portion 77 is threaded towards the rearward end at 82 and the forward end 78 is provided with a peripheral groove 83. The inner cylindrical surface 84 is provided with an annular rebate 85 in the forward end thereof.

The body 75 carries a second body member 86 comprising a cylindrical portion 87 which carries at its rearward end a locking ring 88 which is threaded on its inner surface to co-operate with threads 82 on the outer cylindrical surface of first body member 75. The forward end of second body member 86 is closed by means of end wall 89 which has a central outlet 90 communicating with an outlet 91 which is secured to conduit 29'. The first body member 75 and the second body member 86 together define a valve chamber 92 which accommodates a piston 93 slidable within the inner cylindrical surface of body member 75. The piston 93 is biassed towards inlet nozzle 81 by means of a spring 94 which acts between the rearward surface of wall 89 and the end 95 of counterbore 96 in the forward face of piston 93. The rearward end 97 of piston 93 is counter-bored at 98 and carries a sealing disc 99 adapted, when piston 93 is in its rearmost position, to seal nozzle 81. The piston also accommodates a cranked by-pass passage 100 which extends between the rearward end 97 of the piston 93 and the cylindrical outer surface thereof, the arrangement being such that when the piston 93 moves forwardly under the influence of fluid under pressure entering cavity 92 from nozzle 81, as the orifice of by-pass 100 in the cylindrical surface clears or coincides with rebate 85 fluid can pass from the rear portion of the valve cavity defined by body member 75 and piston 93 to the forward portion of the valve cavity defined by body member 86 and piston 93, to pass out of outlet 90. When the pressure of the fluid supplied via nozzle 81 drops below a predetermined level, spring 94 urges piston 93 towards nozzle 81 thereby obturating the outlet of by-pass 100 and reducing before quickly terminating the flow of fluid to prevent the dribble of fluid from a spray nozzle debouching into the inlet manifold of an internal combustion engine.

In order to control the flow of fluid under operating conditions, a control device is inserted in line 29' which comprises a 'T' piece 110, one end of which 111 communicates with conduit 29' and which is closed by means of a plug 112 carrying a capillary tube 113. The opposed outlet 114 of 'T' piece 110 is also closed by means of a plug 115 which accommodates a needle 116 in sliding relationship therewith and axially aligned with capillary 113. The remaining outlet 120 is connected with conduit 29''. The needle carries, in the portion thereof extending between capillary 113 and plug 115 a seal 121 which by sliding the needle 116 to its extremity within the capillary 113 acts to seal the outlet orifice 122 of capillary 113 to terminate the fluid from conduit 29' to conduit 29''. The rate of flow is controlled by progressive withdrawal or insertion of needle 116 into capillary 113 thereby increasing or decreasing the capillary path for fluid flowing between the outer cylindrical surface of needle 116 and the inner cylindrical surface of tube 113, thereby increasing or decreasing resistance to flow as the case may be.

The conduit 29'' is connected with a nozzle indicated generally at 130, the nozzle being disposed in the inlet manifold 131 of the engine within which the apparatus is employed. In the particular embodiment illustrated in FIG. 6 of the accompanying drawings, a carburettor inlet 132 carries bolted thereto, by means of the usual mating flanges 133 and bolts 134, an inlet manifold 131. The carburettor inlet 132 and the manifold inlet 131 are curved upwardly, and the manifold inlet 131 carries at its upper end an air cleaner 135. The air cleaner is secured to the upper end of the manifold 131 by means of a stud 136 which threadably engages a projection 137 on the innernal wall 138 of the manifold 131. The upper end of the stud 136 carries a washer 139 with a wing nut for readily securing and releasing the air cleaner 135 from the manifold 131. The upper surface 140 of the air cleaner 135 carries an upstanding support 141 adapted to accommodate the extremity of conduit 29''. The conduit 29'' communicates with one end of a tube 142 which accommodates the extremity of the nozzle 143. The tube 142 is curved to enter the air cleaner 135 and passes through a second support block 144 and the nozzle 143 is disposed just below the lower surface of the filter 135. The support block 144 carries a stirrup 146 having a lower baffle 147 of triangular section with a planar surface directed towards nozzle 143 and substantially perpendicular to the nozzle axis, the arrangement being such that the triangular section 147 is in spaced axial relationship with the nozzle 143, which spacing can be adjusted to permit control of the resulting spray.

In operation, liquid is pumped along conduit 29'' to debouch into the manifold just below the lower surface of air cleaner 135. The stirrup member 146 serves to ensure adequate break up of the jet into fine droplets.

In operation, pressure changes in the combustion chamber are transmitted via the longitudinal groove 13 in the threaded portion of the spark plug to the annular gap between member 16 and the threaded portion of the spark plug passage 20 to pump inlet 36 and thus acts upon piston 41 to reduce the space between piston 41 and body 30 so that fluid within the space defined between piston 41 and body 30 is pumped out of the outlet valve 24 and along conduit 29 via the dribble valve and control valve through nozzle 132.

As the pressure in the combustion chamber relaxes the movement of piston 41 is reversed to permit operation of the inlet valve to admit liquid into said space preparatory to the next movement of the piston member 41.

It has been found that the apparatus of the kind described can produce a steady flow of fluid into the air cleaner of an engine and has produced useful savings in fuel and has permitted lower grade fuel to be employed. The apparatus of the present invention may also be used to detect a faulty cylinder of the multi-cylinder engine and pressure gauge readings are taken of the fluid pressure in conduit 29. Comparative readings being taken when the device is moved to alternative cylinders. Furthermore, dribbling of the fluid from the nozzle under idle conditions is substantially eliminated while the amount of fluid can be controlled under constant load conditions, such for example, when motorway driving in an automobile.

I claim:

1. An internal combustion engine having means for feeding fuel into each combustion chamber of said engine and apparatus for the introduction of fluids other than fuel into an air inlet passage of said engine, which apparatus comprises:

a supply of fluid other than fuel;

injection means for injecting said fluid into said air inlet passage of said engine prior to entering a combustion chamber of said engine;

means for sensing pressure variations in at least one combustion chamber of said engine;

a pump communicating with and responsive to said sensing means for delivering varying amounts of fluid from said fluid supply to said injection means, said amount of fluid being determined by the pressure in said at least one combustion chamber such that the amount of fluid supplied by said apparatus to said air inlet passage varies as a function of the pressure in said at least one combustion chamber of said engine.

2. Apparatus as claimed in claim 1 characterised in that the pressure variations in the combustion chamber provide motor means for said pump, to pump fluid from said pump to said injection means.

3. Apparatus as claimed in claim 1, characterised in that said pump means comprises, a pressure chamber, a floating piston movable within said pressure chamber in response to pressure changes in said chamber, inlet valve means into said pressure chamber and connected to said fluid supply means, outlet valve means out of said pressure chamber and connected with said fluid outlet means, whereby movement of said floating piston in response to pressure changes in said pressure chamber results in a pumping of fluid from said inlet valve means to said outlet valve means.

4. Apparatus as claimed in claim 3 characterised in that both said valve means comprise a valve body having an upstream side with respect to the flow of pumped fluid therethrough and a downstream side, a plurality of holes in said valve body for the passage of fluid from said upstream side to said downstream side and a resilient valve element fixedly secured to said body and juxtaposed said holes so that the edge of said element lifts to allow fluid to pass through said holes, said resilient valve element being flexed in the rest position to exert a bias so that on lifting to permit the passage of fluid, said resilient valve element moves against its bias.

5. Apparatus as claimed in claim 3 characterised in that said pressure sensing means includes a spark plug having a conduit thereby for communication between the combustion chamber and said pressure chamber of said pump.

6. Apparatus as claimed in claim 5 characterised in that said spark plug has a threaded portion with roots, an annular ring around said spark plug threaded portion above said roots, said spark plug conduit comprises a longitudinal groove axially disposed in the surface of said spark plug and extending between said roots of said threaded portion of said spark plug and said annular ring and continues into a passage in said annular ring whereby said spark plug and said annular ring may be disposed so that said longitudinal groove and said ring passage communicate one with the other to provide direct communication between the combustion chamber and said pump pressure chamber.

7. Apparatus as claimed in claim 1 characterised in that between said fluid outlet means and said injection means there is an anti-dribble valve to control the flow rate of fluid to the gas stream when the engine is running at slow speed, said anti-dribble valve comprising a valve chamber, a piston longitudinally slidable in said chamber, an inlet communicating with said fluid outlet means and debouching into said chamber, inlet closing means carried on said piston for movement therewith and adapted to close said inlet when said piston is juxtaposed thereto, biassing means to urge said piston to a position at which said inlet is closed, an outlet from said chamber on the side of said piston opposite said inlet and a by-pass within said piston with said outlet and said bypass being so shaped and positioned that said bypass is adapted to communicate with the said outlet when said piston is urged against said biassing means by fluid under pressure, whereby when the rate of fluid supply falls, said biassing means urges said piston towards the closed position whereby the communication between said by-pass and said outlet is obturated to curtail fluid supply from said inlet to said outlet.

8. Apparatus as claimed in claim 1 characterised in that said means for sensing pressure variations in the combustion chamber include a longitudinal conduit for the transmission of pressure changes between the combustion chamber and said pump, said longitudinal conduit portion accommodating a longitudinal member disposed therein of smaller cross-section than said longitudinal passage so that the spacing between said conduit and said member form a passage of predetermined cross sectional area and whereby the motor pressure applied to said pump may be varied by varying the thickness of said longitudinal member within said conduit.

9. Apparatus as claimed in claim 1, characterised by said pump having a pump chamber, said fluid supply means comprising an inlet to said pump chamber and connectable to a liquid source, an inlet valve associated with said inlet, said fluid outlet means comprising a pump outlet communicating with said pump chamber, an outlet valve associated with said pump outlet, a nozzle adapted to inject into an inlet gas stream of an internal combustion engine connected with said pump outlet, a floating pump piston disposed within said pump chamber and movable therein due to pressure variations therein and conduit means connecting between a combustion chamber of the engine and said pump chamber whereby variations in the pressure in the combustion chamber are communicated to the pump chamber and cause movement of the floating piston which acts to pump liquid from said inlet to said outlet and from said outlet to said nozzle.

10. In combination, the apparatus according to claim 3 and an internal combustion engine having at least one combustion chamber and an inlet passage leading to said combustion chamber, said pump outlet valve means being connected to said inlet passage of said combustion chamber.

* * * * *